US009245707B2

(12) United States Patent
Tuohimaa et al.

(10) Patent No.: US 9,245,707 B2
(45) **Date of Patent: *Jan. 26, 2016**

(54) COATED X-RAY WINDOW

(75) Inventors: Tomi Tuohimaa, Kista (SE); Oscar Hemberg, Kista (SE)

(73) Assignee: EXCILLUM AB, Kista (SE)

( * ) Notice: Subject to any disclaimer, the term of this patent is extended or adjusted under 35 U.S.C. 154(b) by 0 days.

This patent is subject to a terminal disclaimer.

(21) Appl. No.: 14/404,836

(22) PCT Filed: May 29, 2012

(86) PCT No.: PCT/EP2012/060042

§ 371 (c)(1),
(2), (4) Date: Jan. 9, 2015

(87) PCT Pub. No.: WO2013/178251

PCT Pub. Date: Dec. 5, 2013

(65) Prior Publication Data

US 2015/0146866 A1 May 28, 2015

(51) Int. Cl.

| | |
|---|---|
| ***H01J 35/18*** | (2006.01) |
| ***H01J 35/02*** | (2006.01) |
| ***H05G 1/02*** | (2006.01) |

(52) U.S. Cl.

CPC ..... *H01J 35/18* (2013.01); *H01J 35/025* (2013.01); *H05G 1/02* (2013.01)

(58) Field of Classification Search

CPC ..... H05G 1/08; H01J 35/00; H01J 35/02; H01J 35/025; H01J 35/04; H01J 35/18; H01J 2235/00; H01J 2235/02; H01J 2235/12; H01J 2235/122; H01J 2235/1225; H01J 2235/1291; H01J 2235/1295; H01J 2235/18; H01J 2235/183

USPC ..... 378/91, 119, 121, 140–143, 193, 204

See application file for complete search history.

(56) References Cited

U.S. PATENT DOCUMENTS

| | | | |
|---|---|---|---|
| 6,005,918 | A | 12/1999 | Harris et al. |
| 2011/0317818 | A1 | 12/2011 | Hertz et al. |
| 2013/0235979 | A1 | 9/2013 | Hemberg et al. |

FOREIGN PATENT DOCUMENTS

| | | | |
|---|---|---|---|
| JP | 62 036546 | A | 2/1987 |
| JP | 62-64949 | U | 4/1987 |

(Continued)

OTHER PUBLICATIONS

International Search Report (PCT/ISA/210) mailed on Feb. 4, 2013, by the European Patent Office as the International Searching Authority for International Application No. PCT/EP2012/0600042.

(Continued)

*Primary Examiner* — Anastasia Midkiff

(74) *Attorney, Agent, or Firm* — Buchanan Ingersoll & Rooney P.C.

(57) ABSTRACT

An X-ray window includes a primary and a secondary window element. In order to evaporate debris by ohmic heating, current flows through the secondary (upstream) window element. Meanwhile, electric charge originating from electron irradiation and/or depositing charged particles is to be drained off the secondary window element via a charge-drain layer. To prevent large debris particles from short-circuiting the secondary window element, the current for heating the window element flows through heating circuitry which is electrically insulated from the charge-drain layer.

19 Claims, 6 Drawing Sheets

(56) References Cited

FOREIGN PATENT DOCUMENTS

| | | | |
|---|---|---|---|
| JP | H06-102214 | A | 4/1994 |
| JP | 7-280748 | A | 10/1995 |
| JP | 8-138613 | A | 5/1996 |
| JP | 2008-277481 | A | 11/2008 |
| JP | 5108367 | B2 | 12/2012 |
| WO | WO 2010/083854 | A1 | 7/2010 |
| WO | WO 2012/072146 | A1 | 6/2012 |

OTHER PUBLICATIONS

Written Opinion (PCT/ISA/237) mailed on Feb. 4, 2013, by the European Patent Office as the International Searching Authority for International Application No. PCT/EP2012/0600042.

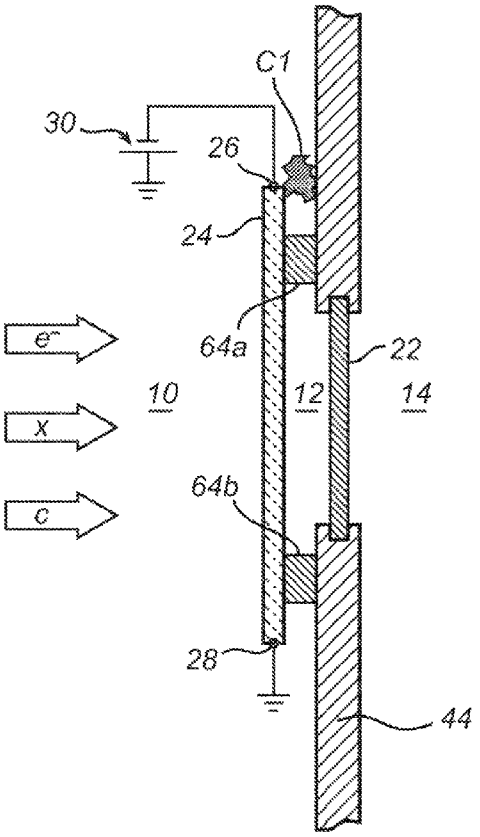
(Prior art) Fig. 1
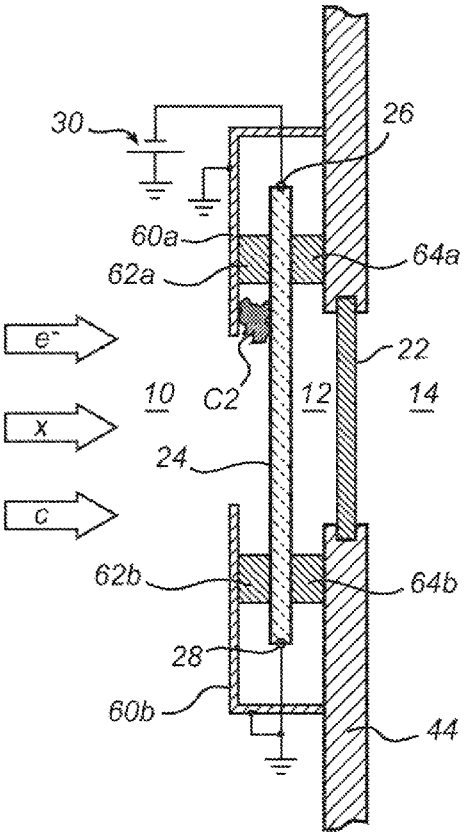
(Prior art) Fig. 2

COATED X-RAY WINDOW

TECHNICAL FIELD OF THE INVENTION

The invention disclosed herein generally relates to the installation of electron-impact X-ray sources. More particularly, it relates to an X-ray window suitable as a part of a vacuum casing for an X-ray generation arrangement including a liquid-jet anode.

BACKGROUND OF THE INVENTION

The co-pending International Application published as WO 2010/083854, which is incorporated herein by reference, discloses a self-cleaning window arrangement for separating atmospheric pressure from vacuum while letting X-ray radiation pass through. The window arrangement has heating means for cleaning an inner surface, facing the vacuum, in order to evaporate a contaminant during operation. In particular, the window can be cleaned from splashes, droplets and depositing mist from the liquid-jet anode.

SUMMARY OF THE INVENTION

It is an object of the present invention to propose an X-ray window with an improved robustness against contamination. A particular object is to propose an X-ray window with a robust self-heating functionality.

An X-ray window, for separating an ambient pressure region from a reduced pressure region, comprises:

- a primary X-ray-transparent window element separating the ambient pressure region from an intermediate region;
- a secondary window element separating the intermediate region from the reduced pressure region and having a side facing the reduced pressure region for receiving a contaminant depositing thereon; and
- heating means for applying an electric voltage between terminals of the secondary window element for thereby evaporating contaminant having deposited thereon.

Such a window may be provided in the wall of a vacuum or near-vacuum chamber (reduced pressure region) of an X-ray source and allows generated X-rays to leave the chamber while preserving the necessary (near-)vacuum conditions. In the case of an X-ray source with a jet of liquid metal, the contaminant may be metal debris from the anode. Even though debris accumulates on the secondary window element during normal operation of the X-ray source, it is possible to conveniently clean the secondary window element according to the invention without disassembling the X-ray source or releasing the vacuum, or without even interrupting normal operation of the source.

The inventors have realised that a window of the kind described is susceptible of a failure condition in which a debris particle establishes an electrical and/or thermal connection with an element adjacent to the window. As shown in FIG. 1, a debris particle C1 is located between a housing 44 and an electrically heated secondary window element 24 forming the inner surface. If the housing 44 is earthed, a portion of the current provided by source 30 may escape through the particle C1 instead of heating the secondary window element 24. Even if the housing 44 is electrically insulated, as the case may be, the particle C1 will act as a heat sink and cause the secondary window element 24 to deviate from the intended temperature distribution. This will hamper the self-cleaning action of the window.

FIG. 2 illustrates a failure condition in a window arrangement comprising a charge-absorbing screen 60 surrounding the secondary window element 24. The screen 60 may be useful in applications where the window boundary and equipment associated thereto requires protection from electron or X-ray irradiation or from contaminant. To allow the ohmic heating of the secondary window element 24 to proceed orderly and to conserve the heat produced, the window element 24 is separated from the screen 60 by thermally and electrically insulating spacers 62. A contaminant particle C2 located between the secondary window element 24 and the screen 60 will create an undesirable electric and/or thermal connection between these elements. In particular, the electric current flowing from the current source 30 may concentrate in a short segment from a connection point 26 up to the particle C2. Therefore, since the particle C2 itself renders the heating less efficient, it may take the window considerable time to recover from the failure condition.

In view of these shortcomings, the invention provides an X-ray window in accordance with claim 1. Advantageous embodiments are defined by the dependent claims.

In an aspect of the invention, the secondary window element comprises:

- a charge-drain layer, which faces the reduced pressure region and is connected to a charge sink; and
- heating circuitry, which is electrically insulated from the charge-drain layer, wherein said terminals, between which the voltage is applied, are located at a plurality of distinct points on the heating circuitry.

Hence, the invention is based on the realisation that the secondary window element in the prior art window is responsible for charge transport of two different types—both the ohmic heating to evaporate debris and the draining of charge transmitted to the element by charged debris particles or direct electron irradiation—and, further, that it is advantageous to separate the two types of charge transport. If the two types of charge transport take place in separate parts of the secondary window element, such as a part containing the heating circuitry and a charge-drain layer, the heating circuitry can be located where it is protected from deposition of debris that would otherwise be likely to perturb its functioning. The invention will correct the failure condition shown in FIG. 2 faster than the prior art, because the ohmic heating will continue to operate despite the undesired electric connection through the debris particle C2 between the screen 60 and the secondary window element 24. Likewise, the failure condition shown in FIG. 1 can be easily forestalled by the invention, which may be embodied using a secondary boundary element on which the heating circuitry ends a distance from the boundary, which is the portion most exposed to debris.

According to the present invention, ohmic heating is effected by means of the heating circuitry, which is advantageous in that standard (or off-the-shelf) heating wire may be used in the X-ray window, whereby manufacturing is facilitated and manufacturing costs can be reduced. The heating circuitry may e.g. be a simple electrically conducting thread or a printed electrically conducting path or pattern, through which current may be conducted for providing ohmic heating. The heating capacity may also be provided by mounting a ready-made thin-film heater on one side of the secondary window. Thin-film heaters typically comprise a flexible electrically insulating film (e.g., made of polyamide or polyester) on which a heating line (e.g., thread, wire, printed or painted pattern) is arranged in an undulating pattern. Such thin-film heaters are commercially available e.g. from the suppliers OMEGA Engineering, Inc., Heraeus Noblelight, LLC and Bucan Electric Heating Devices, Inc.

In the cases described above, the heating circuitry is a substantially linear structure: it may contain an undulating electrically conductive line, or a plurality of electrically conductive lines forming a pattern which extends over at least a portion of the surface of the window element. Protection is not sought for a secondary window element that includes a solid homogeneous heater layer or a homogeneous heater layer with a hole pattern produced by cutting, stamping, punching or the like. Protection is not sought for a secondary window element that includes a heater layer formed by spraying or vapour deposition onto an insulating layer, such as through a masking film.

In an embodiment, the heating circuitry may comprise an electrically insulated wire, which is advantageous in that no additional electrically insulated layer is required for obtaining electrical insulation between the heating circuitry and the charge-drain layer. Further, spacers for securing the secondary window to the housing (or for supporting the secondary window element) may not necessarily be made of electrically insulating material, as the heating circuitry itself is insulated according to the present embodiment. The heating circuitry may be separately insulated (in the manufacturing process) and e.g. wrapped in (or surrounded by) an electrically insulating material, such as plastic, preferably of a heat resistive type. In an embodiment, the (insulated) heating circuitry may be arranged in abutment with the charge-drain layer, whereby improved heat transfer from the heating circuitry to the charge drain-layer is obtained.

In an alternative embodiment, the X-ray window may further comprise an electrically insulating layer arranged to electrically insulate the charge-drain layer from the heating circuitry, which is advantageous in that the risk of charge leakage between the heating circuitry and the charge-drain layer is reduced. Optionally, an electrically insulating layer may be used in combination with an insulated heating wire.

In an embodiment, the secondary window element may further comprise a first region and a second region, wherein the first region has a higher transparency to X-ray radiation than the second region. The present embodiment is advantageous in that the first region may be arranged in the secondary window at a location intended to intersect an emission path of X rays produced by the X-ray source in normal operation. Hence, less X-ray radiation will be absorbed by the secondary window element when it is properly aligned.

In a further development of the preceding embodiment, the first region 77 is characterised by a relatively smaller thickness of at least one further layer as well. For instance, the electrically insulating layer 74 and/or the charge-drain layer 76 may be locally thinner in the first region 77.

In an embodiment, the electrically insulating layer may comprise an indentation (or recess) located at the first region for providing the higher X-ray transparency. Hence, the electrically insulating layer may be thinner in the first region than in the second region, so that an indentation or recess may be defined. The present embodiment is advantageous in that more reliable electrical insulation is provided in the second region (than in the first region), thereby reducing the risk of charge leakage between the heating circuitry and the charge-drain layer, while higher X-ray transparency is obtained in the first region.

In an embodiment, the electrically insulating layer may define an aperture (or through hole) located at the first region. The aperture may be provided in the electrically insulating layer only. Alternatively, there may be a corresponding aperture in the charge-drain layer. Similarly as in the previously described embodiment, higher electrical insulation is provided in the second region (than in the first region), thereby reducing the risk of charge leakage between the heating circuitry and the charge-drain layer, while higher X-ray transparency is obtained in the first region. It is noted that a similar need for electric insulation need not arise in the first region if this is substantially free from electric circuitry, which also avoids the risk of charge leakage. With the present embodiment, the electrically insulating layer may be made of a material having low (or even close to zero) X-ray transparency, as the aperture provides an X-ray transparent region.

In an embodiment, the heating circuitry may be arranged in an undulating pattern, preferably across the secondary window, which is advantageous in that the heating circuitry is distributed over the charge-drain layer, which thus is more uniformly heated by the heating circuitry. The uniformity may be quantified as a low variation in the wire density (as expressed in meter wire per unit area) over the secondary window element. Preferably, the undulating pattern covers a major part of the secondary window element. In an embodiment, the undulating pattern may have a lower density in the first region than at the second region, which is advantageous in that the heating circuitry not necessarily have to be made of a material having a high X-ray transparency. The lower density of the undulating pattern provides a higher X-ray transparency of the first region, as a smaller amount of heating line covers the first region. Preferably, the heating circuitry may be arranged such that it does not cover (or intersect) the first region, but instead runs around the first region. Even though the heating circuitry is less densely arranged in the first region, the charge-drain layer in the first region may still be sufficiently heated, as heat may be conducted by the electrically insulating layer and/or the charge-drain layer from the second region.

In an embodiment, the charge-drain layer may define an indentation (or recess) located in the first region for providing the higher X-ray transparency. Hence, the charge-drain layer may be thinner at the first region than in the second region. The present embodiment is advantageous in that the most suitable thickness can be chosen for the charge-drain layer in the second region in view of structural stability, wear resistance, electrical conductivity etc. but not necessarily X-ray transparency, while higher X-ray transparency is obtained in the first region. With the present embodiment, a less X-ray transparent material may be used in the charge-drain layer as a higher X-ray transparency is obtained at the first region by the thinner portion of the charge drain layer at the indentation. The present embodiment is also advantageous in that, since the second region is allowed to be thicker, the secondary window element is more rigid.

In an embodiment, the heating circuitry may comprise a bifurcated electric line. For example, the heating wire may comprise two or more electrically parallel lines extending from one or more connection points.

In an embodiment, the heating circuitry may contain one of the following materials: graphite, pyrolytic carbon, high-resistance metals and alloys, heat-proof metals and alloys (i.e., metals and alloys with an elevated melting point), high-resistance heat-proof metals and alloys.

For the purpose of this disclosure and particularly the claims, the terms “debris” and “contaminant” are used interchangeably. It is understood that the “electrically insulating layer” may have high or low thermal conductivity, depending on the intended application. If for instance debris depositing on the axially opposite side of the window element is to be removed, then the electrically insulating layer preferably has high (axial) thermal conductivity. On the other hand, if debris is to be evaporated on an element in thermal contact with the heating circuitry but not on the axially opposite side of the window element (e.g., if the secondary window element is partially non-transparent to X-rays), then it is more economical to select an electrically insulating material that is also thermally insulating. Further, the "charge-drain layer" is adapted to drain electric charge from the window element, so as not to become electrostatically charged to any significant extent. To achieve this, the charge-drain layer may be on any suitable electric potential, such as earth potential, a constant non-earth potential (either attractive or repulsive in relation to the electrons) or a fluctuating potential. Further, the charge-drain layer is electrically conductive, at least in a transversal direction of the secondary window element, so that electric charge can be drained off the window element and proceed to the charge sink. The invention may be embodied as an unscreened window, similarly to FIG. 1. This provides a simple and efficient construction, which can nevertheless be made robust by arranging the heating circuitry in a position sheltered från debris splashes, such as by letting it end a distance from the boundary of the secondary window element.

In one embodiment, the secondary window element is at least partially surrounded by a screen on the side facing the reduced-pressure region. Preferably, the screen acts as a charge drain by being connected to a charge-absorbing body (or charge sink, e.g., earth) and by being electrically conductive. The screen shelters the edges, mechanical securing means and electric connections, if any, of the secondary window element against direct exposure to debris, including splashes or travelling droplets.

In one embodiment, the secondary window element is surrounded by a charge-draining screen and the charge-drain layer of the secondary window element is connected to the screen by being fitted to it via a thermally insulating spacer. The spacer is in electrical contact with both the screen and the charge-drain layer of the window element. The spacer itself is sufficiently electrically conductive to drain off the charge impinging on the secondary window element. Typically, the charge impinging on the window element is of the order of micro-amperes. It is economical to insulate the secondary window element thermally, since less heating power will be needed, and the use of a weaker heating current will increase the working life of the heating circuitry.

In one embodiment, the secondary window element is surrounded by a charge-draining screen and is fitted to this via a thermally and electrically conducting spacer. To achieve the desired draining of charge from the charge-drain layer, this layer is connected to the screen via a filament. The filament is preferably slack so as to accommodate thermal expansion of the secondary window element and/or the screen.

In one embodiment, the heating circuitry may be encapsulated (or embedded) in the electrically insulating layer and a portion of a boundary of the electrically insulating layer may be secured by being inserted into a slit in a reservoir containing electrically conducting liquid. Further, the insulating layer may be flush with the heating circuitry and optionally also with the charge-drain layer, or may extend outside the charge-drain layer. The above described distances between the boundaries of the parts of the secondary window make the electric insulation of the parts more robust. They may also simplify the electric and mechanical fastening of the secondary window element, since a portion of it can be inserted into a slit in a reservoir with electrically conducting liquid. Such fastening may be achieved similarly to FIG. 3 of WO 2010/083854. It secures the window element axially and may secure it in some transversal directions as well. Advantageously, the secondary window element is allowed to expand and contract in response to temperature changes. If two segments of the boundary of the window element are inserted into slits in different reservoirs, a current for ohmic heating may be driven through the heating circuitry. If the heating circuitry and the electrically insulating layer are flush with one another at the edge, both may be inserted into the slit in the container.

In a variation to this embodiment, the heating circuitry does not extend outside the insulating layer, and the charge-drain layer extends at least a positive distance outside the heating circuitry. The insulating layer may be flush with either external layer, or may end between the respective outer boundaries of the heating circuitry and the charge-drain layer. This geometry applies at least over a portion of the boundary of the secondary window element. Since the charge-drain layer constitutes the outermost portion of the secondary window element in said portion, it is convenient to secure this layer by inserting it into a slit in a reservoir, where it makes contact with an electrically conducting liquid. If the charge-drain layer and the electrically insulating layer are flush with one another, both may be inserted into the slit in the container. Preferably, the liquid is in turn electrically connected to a charge sink. It is possible though not necessary to connect more than one boundary segment of the window element by insertion into a slit, since both the thermal expandability and the charge-draining capacity will already be achieved by one.

In one embodiment, the electrically insulating layer constitutes the outermost portion of the secondary window element, at least over a portion of its boundary. In this portion, more precisely, the electrically insulating layer may extend a first distance outside the heating circuitry and a second distance outside the charge-drain layer, wherein the first and second distances refer to a transversal direction of the window element. This makes the secondary window element easy to mount, since electric insulation of the fastening means is not imperative. If additionally the electrically insulating layer is thermally insulating, the mounting may become even simpler, since the fastening means need not be free from thermally conductive material (e.g., metal) where this is convenient.

It will be appreciated that in the above described embodiments, expressions like "boundary of the heating circuitry" and relative terms like e.g. "extends up to/outside/is flush with the heating circuitry" may refer to the outer boundary of the area over which the heating circuitry is distributed in the transversal direction of the secondary window element.

In one embodiment, the secondary window element is X-ray transparent. Put differently, the window element absorbs radiation in the X-ray wavelength range only to a limited extent. The design choice of window materials with an acceptable X-ray absorbance may be influenced by other properties of the materials, such as electric conductivity, thermal conductivity, mechanical strength, resistance to wear, production engineering aspects etc. Thus, the heated portion of the secondary window element should include at least a central portion, corresponding to the location where the X-ray beam passes through the window element.

In one embodiment, the secondary window element is not necessarily X-ray transparent in the sense discussed above. This allows the materials of the window element to be chosen with greater latitude. To let through the X-ray radiation, it comprises at least one hole. To prevent debris from reaching the primary window element, the hole is provided by an X-ray transparent cover. The cover may also act as a pressure break between the reduced-pressure region and the intermediate region. The hole extends substantially in the axial direction. It may be straight or shaped after the ray cone originating from the interaction region, that is, slightly widening in the ray direction. The cover is preferably in thermal contact with the heating circuitry, either directly or via the other layers of the secondary window element. The cover may overlap the hole aperture on the side of the reduced-pressure region. The cover may also overlap the hole on the side of the intermediary region; this latter mounting is preferable in view of efficient heating of the cover element.

It is noted that the invention relates to all combinations of features disclosed herein, even if they are recited in mutually different claims.

BRIEF DESCRIPTION OF THE DRAWINGS

Preferable embodiments of the invention will now be described in greater detail with reference to the accompanying drawings, on which:

FIGS. 1 and 2 show prior art X-ray windows in two different failure conditions;

Like reference numerals are used for like elements on the drawings. Unless otherwise indicated, the drawings are schematic and not to scale.

DETAILED DESCRIPTION OF EMBODIMENTS

Figure 3:
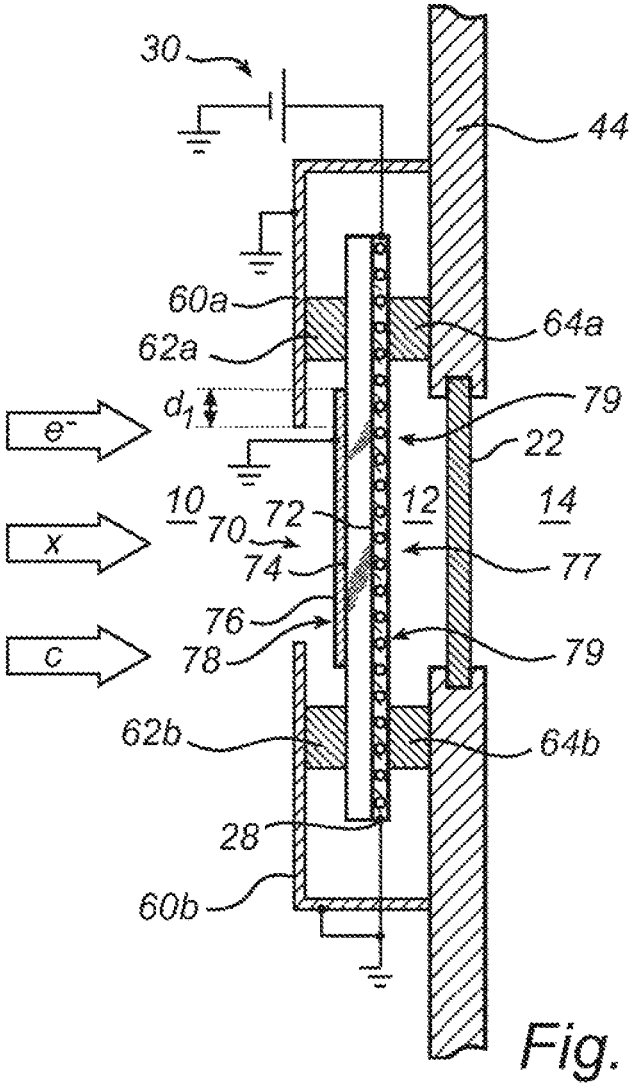
FIG. 3 is a cross-sectional side view of a partially screened X-ray window according to an embodiment of the invention.

FIG. 3 is a cross-sectional view of an X-ray window according to an embodiment of the invention. The figure is partially diagrammatic insofar as an electric current source 30 and several connections to earth are shown symbolically and without regard to their positions in a physical embodiment of the invention. An intended use of the window is the provision of a vacuum-proof X-ray aperture in the housing of an X-ray source. The window arrangement separates a reduced pressure region 10 and an ambient pressure region 14. The reduced pressure region 10 may be the inside of a gas-tight (vacuum-tight) housing 44, which contains equipment for X-ray generation and which, together with a primary window element 22 of the X-ray window, separates this from the environment. During operation of the X-ray generation equipment, the reduced pressure region 10 may be at vacuum or near-vacuum pressure, such as between $10^{-9}$ and $10^{-6}$ bar. As an anode of the X-ray source, a liquid-metal jet (not shown) may be continuously ejected from a nozzle (not shown) during operation.

The window comprises two substantially parallel window elements: the primary window element 22 and a secondary window element 70. The primary and secondary window elements enclose an intermediate region 12. A contaminant C is expected to deposit on that side 78 of the secondary window element 70 which faces the reduced pressure region. The contaminant C may reach the secondary window element 70 in the form of vapour, suspended particles or droplets, or as splashes. Suitable materials for the primary window element 22 include beryllium, which is X-ray transparent at useful thickness values. As opposed to the secondary window element 70, the primary window element 22 does not need to be heat-resistant. The primary window element 22 is secured to the gas-tight housing 44. To allow for thermal expansion, the secondary window element 70 is secured with a clearance at each edge; similar clearances may be provided at those edges of the secondary window element 70 which are located outside the plane of the drawing. It is noted that each of the clearances also acts as a heat insulation between the secondary window element 70 and the housing 44. As an additional heat-conserving measure, the portion of the housing 44 which surrounds the X-ray window may consist of a material with low thermal conductivity. It is advantageous to reduce the heat flux away from the secondary window element 70, because less energy will need to be supplied in order to keep the window element 70 (or a portion thereof) at the desired temperature. This also reduces the need for cooling the X-ray source in the region where the X-ray window is provided.

In this embodiment, the window further comprises a screen 60 covering the top and bottom edges of the secondary window element and thereby protecting sensitive equipment arranged along the edge, including electrical connecting means 26, 28 and the current source 30 if this is located under the screen 60. The screen 60 may cover the right and/or left side (as seen in the axial direction) as well, and may then be manufactured in one piece. Starting from a sheet of metal, preferably corrosion-proof metal such as stainless steel, the screen may be manufactured by punching a hole and subsequently bending the sheet to form edges and corners. In this embodiment, the screen 60 is earthed to avoid a build-up of electric charge.

The secondary window element 70 comprises three parts: a supporting electrically insulating middle layer 74, a charge-drain layer provided on a portion of the side 78 of the element 70 that faces the upstream direction, that is, into the reduced-pressure region 10, and heating circuitry 72 facing the downstream direction and being connected at points 26, 28 to the electric current source 30, whereby ohmic heating can be achieved. In this embodiment, the heating circuitry is embedded in an encapsulating material (e.g., an insulating synthetic resin) except at the connection points 26, 28. As shown in FIG. 3, further, the earthed charge-drain layer 76 does not extend over the whole left side 78 of the secondary window element 70, but only slightly outside the axial projection of the aperture defined by the screen 60. More precisely, the charge-drain layer 76 may extend a distance d1 outside the projection, wherein this distance d1 may be chosen while taking into account the axial distance between the screen 60 and the left side 78 and the maximal angle under which charged debris C or electrons $e^-$ are expected to impinge. Thus, it is the insulating layer 74 and the heating circuitry 72 together, which typically may have a total thickness of 20 μm, that form the upper and lower boundaries of the window element 70. These upper and lower boundaries are secured between spacers 62, 64, which are preferably made of a heat-insulating material, such as $Al_2O_3$ or a machineable ceramic material such as Macor™. Because the right side of the window element 70 is electrically conducting and subject to ohmic heating, the right spacer 64 is preferably electrically insulating as well. If the screen 60 surrounds the secondary window element 70 completely, the spacers may have a closed shape, such as a ring shape, extending in a vertical plane perpendicular to the drawing.

Since the secondary window element 70 will typically not be subject to large local voltages, the electrically insulating layer 74 need not be designed for high breakdown voltages and can thus be made comparatively thin. This implies that a wide range of materials will be sufficiently X-ray transparent for most applications. Indeed, a transmittance above 90 percent at 9.25 keV is to be expected for 0.1 mm thick layers of the following materials: BeO, BN, CVD diamond. Many more materials will be suitable if the layer is manufactured by vapour deposition, by which thicknesses below 10 μm can be readily achieved. At higher energies than 9.25 keV, a wide range of further electric insulation layers (a layer being a specific thickness of a specific material) will be available. $SiO_2$ and $Al_2O_3$ are generally suitable for use as an electrically insulating layer 74. The electrically insulating layer 74 may be produced by vapour deposition on another layer of the window element 70, or by spraying, sputtering or doctor-blading onto a substrate or another layer. It may also consist of a prefabricated film.

Preferably, the secondary window element 70 may comprise a first region 77 and a second region 79, wherein the first region 77 has a higher transparency to X-ray radiation than the second region 79. Preferably, the first region 77 may be located at a mid portion of the secondary window element 70, where a major part of the X-ray radiation is supposed to pass.

The dimensioning of the first and second regions may be based on the following considerations. The first region 77 is centred on the normal X-ray emission path from the interaction region and is large enough to accommodate X ray emission along paths that deviate to some extent from the normal emission path, e.g., as a result of deflection, vibrations, misalignment, incomplete calibration etc. The dimensions of the second region 79 are determined with account taken of the size of the first region 77 and of the properties of the elements that are in contact with the edge of the secondary window element 70, particularly the temperature in operation, thermal conductivity and other thermal properties of the spacers 62, 64. Each of these factors may influence primarily the size (e.g., diameter) of the second region 79 or the area or both. If the edge is subject to larger local variation, the second region 79 may need to be wider in the radial direction, so that there is sufficient distance to allow boundary effects to even out or decay. An increase in a dimension of the second region 79 will typically cause local temperature gradients to decrease. Further, the heating power per unit area may be limited, as a result of maximum acceptable density of the heating circuitry 72 and/or of a maximum acceptable local temperature (in view of corrosion etc.) in the second region 79. Such heating power limitation gives rise to a lower bound on the area of the second region 79, so that steady-state heat equilibrium can be maintained. There is typically a correlation between the areas of the first and second regions 77, 79, because a larger first region 77 will give off relatively more heat than a smaller one. In one embodiment, the first region 77 occupies a circular region with diameter 4 mm in a secondary window element 70 which is 10 mm by 20 mm.

The heating circuitry 72 may e.g. consist of a conductive material which is X-ray transparent at the relevant thickness, such as graphite or preferably glassy carbon having a diameter (or thickness) around 100 μm or preferably less at 9.25 keV. Other thicknesses may apply for other combinations of materials and energies, wherein dense materials and low energies may necessitate a relatively small thickness. For high grade applications, such as medical imaging, an intensity variation of less than 1% over the cross section of the emitted X ray beam is typically acceptable. However, the heating circuitry 72 may alternatively consist of a conductive material which is not sufficiently X-ray transparent at the relevant thickness and instead be arranged in a pattern having a lower density (local heating power or wire length per unit area) in the first region 77 than in the second region 79, such that a smaller amount of heating circuitry 72 covers the first region 77 than the second region 79. This may ensure that the heating circuitry 72 in itself contributes only to a limited extent to the intensity variation over the cross section of the emitted X-ray beam; clearly, the contribution may decrease down to zero if the heating circuitry 72 is completely contained in the second region 79. In this configuration, however, the heating of the first region 77 relies more heavily on conduction of thermal energy from the second region 79 into the first region 77, so that it may become more demanding to achieve an even temperature in the first region 77.

Preferably, the heating circuitry 72 may be a painted or printed conduction path or a prefabricated heating wire, preferably of standard type, so as to facilitate building of the secondary window element 70. For example, the heating circuitry may be arranged in a prefabricated thin-film heater. Thin-film heaters typically comprise a flexible electrically insulating film (e.g. made of polyamide or polyester) at which a heating line is arranged in an undulating pattern. Such thin-film heaters are commercially available e.g. from the suppliers OMEGA Engineering, Inc., Heraeus Noblelight, LLC and Bucan Electric Heating Devices, Inc. The charge-drain layer 76 may consist of an electrically conductive material which is X-ray transparent at the relevant thickness. Conductive or semi-conductive materials with a relatively low vapour pressure, relatively high melting point and fair corrosion resistance against hot molten metal are preferred. Carbon, such as graphite, doped diamond or amorphous carbon is very suitable. Thin layers of Cr, Ni or Ti are fairly suitable. Relatively thinner layers of refractory metals (including Nb, Mo, Ta, W, Re) are suitable, especially with regard to corrosion resistance. The charge-drain layer 76 may be formed on top of the electrically insulating layer 74 by spraying the material emulsified or dissolved in a solvent onto the layer 74, by carrying out vapour deposition or by some other method. To achieve its function, the charge-drain layer 76 is to be electrically connected; it is advantageous to provide an electrical connection that has low thermal conductivity so that the ohmic heating of the secondary window element 70 can be run in an energy-economical fashion.

The secondary window element 70 may be assembled into its final three-part structure by bonding or welding together prefabricated parts (i.e., a prefabricated charge-drain layer, electrically insulating layer and heating circuitry). As has been outlined above, the parts may also be formed one on top of the other (as a stack) in a suitable order. In designing the secondary window element 70, the materials are to be chosen both with regard to their individual properties and to their compatibility as a three-part structure; this may include matching their coefficients of thermal expansion and assessing the thermal and/or mechanical wear after a large number of load cycles.

Figure 4:
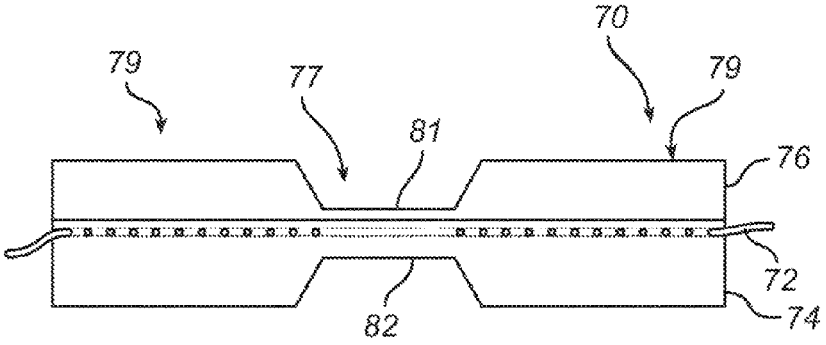
FIG. 4 is a cross-sectional side view of a secondary window element according to an embodiment of the present invention.

FIG. 4 is a cross-sectional view of an example showing how the secondary window element 70 may be arranged. In the present example, the heating circuitry 72 may be fully or partially encapsulated by the electrically insulating layer 74. Preferably, the heating circuitry 72 may be arranged in the electrically insulating layer 74 as close as possible to the charge-drain layer 76 provided it still achieves sufficient electrical insulation between the heating circuitry 72 and the charge-drain layer 76. Further, an indentation 81 may be formed in the charge-drain layer 76, which thereby defines the first region 77 having a higher X-ray transparency. The remaining (or thicker) portion of the charge-drain layer 76 may accordingly define the second region 79 having a lower X-ray transparency. Furthermore, an indentation 82 may be formed in the electrically insulating layer 74 so as to obtain an increased X-ray transparency at the first portion 77. The remaining portion of the electrically insulating layer 74 may preferably be thicker than the intended portion 82 so as to provide a stiffer structure of the secondary window element 70 and for providing a reliable electrical insulation between the heating circuitry and any means for supporting the secondary window in the housing 44.

Figure 5:
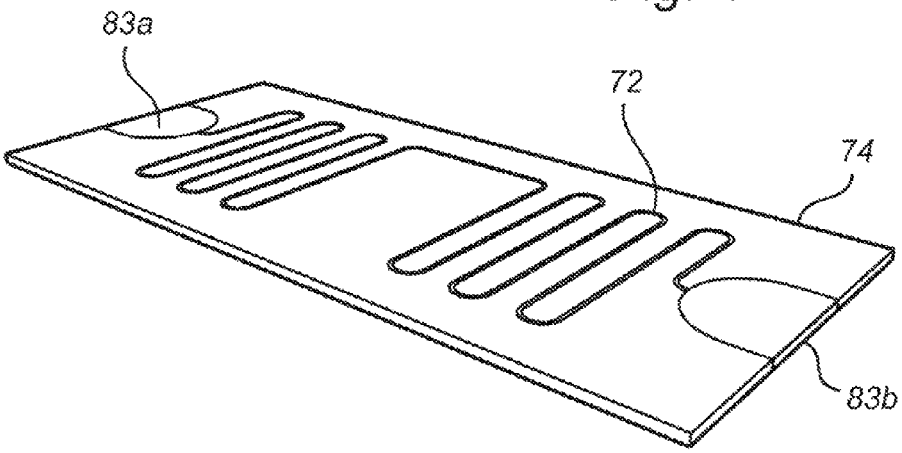
FIG. 5 is a perspective view of an electrically insulating layer and heating circuitry of the secondary window element according to an embodiment of the present invention.

FIG. 5 is a perspective view of the heating circuitry 72 disposed on the electrically insulating layer 74 seen from the side facing the primary window element 22. The heating circuitry 72 may preferably be arranged in an undulating pattern so as to uniformly cover a major portion of the charge-drain layer 76 and thereby provide a rather uniform heating of the charge-drain layer 76. However, at the first region 77 (corresponding to the mid portion of the electrically insulating layer 74 shown in FIG. 5), the undulating pattern may preferably have a lower density (i.e., the heating circuitry may be less dense) for providing an increased X-ray transparency. Preferably, the heating circuitry 72 may be arranged such that is does not cross (or intersect) the first region 77, which may be obtained by arranging a space in the undulating pattern between two portions of the heating circuitry 72, as shown in FIG. 5. The heating circuitry 72 may at its ends be in electrical connection with terminals 83 for connecting the heating circuitry to a current source 30. It will be appreciated that the terminals 83 may be arranged in any convenient manner adapted to electrically, and optionally also mechanically, connect the secondary window element to other parts of the X-ray window. In the present disclosure, the term "terminals" is to be interpreted as functional terminals, which may optionally include physical terminals. For example, the terminals may comprise contact sheets, as shown in FIG. 5, or solder connections for electrically connecting the ends of the heating circuitry 72 to the current source 30. However, the terminals 83 may also simply be seen as two points (or portions) of the heating circuitry 72, between which current is allowed to flow to provide ohmic heating of the secondary window element 70.

In an embodiment (not shown), the heating circuitry 72 may be an insulated heating wire, whereby the electrically insulating layer 74 may be omitted. The heating circuitry 72 may then be arranged in direct abutment with the charge-drain layer 76 (that is, the insulating cover of the insulated heating wire abuts the charge-drain layer 76). Optionally, however, heating circuitry in which the electrically conductive line is insulated may as well be used in combination with an electrically insulating layer 74.

Figure 6:
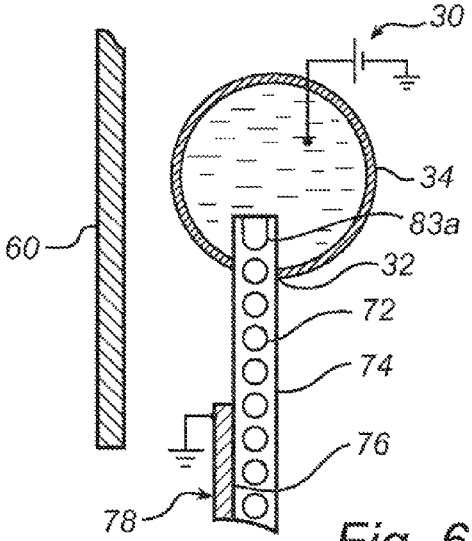
FIG. 6 shows a method of securing a secondary window element electrically and mechanically, in accordance with an embodiment of the present invention.

FIG. 6 is a detailed view of the top edge of the secondary window element 70 and a vertical portion of the screen 60. FIG. 6 illustrates an advantageous way of connecting the secondary window element 70 electrically and mechanically to other parts of the X-ray window. The edge of the window element 70, namely the electrically insulating layer 74 and the heating circuitry 72 (enclosed in the electrically insulating layer 74) as a compound element, is inserted into a slit 32 in a reservoir 34 containing electrically conductive liquid. The liquid is electrically connected to the current source 30 and the reservoir 34 is mechanically secured to a part of the window, such as the screen and/or the housing 44, possibly via a spacer. The terminal 83 of the heating circuitry 72 is thus electrically connected to the current source 30 via the conductive liquid. As explained in WO 2010/083854, a connection of this type allows the window element 70 to expand thermally.

Figure 7:
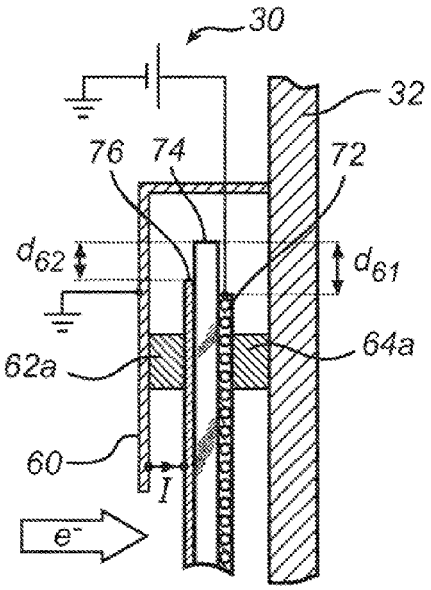
FIGS. 7 and 8 show two preferable methods of connecting charge-drain layers of the secondary window element to a screen.
Figure 8:
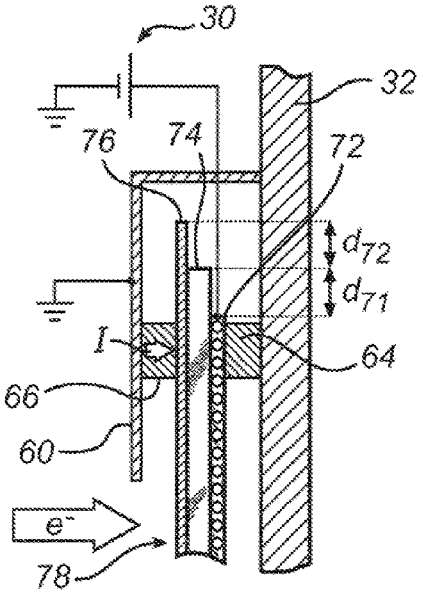

FIGS. 7 and 8 illustrate two further ways of connecting the charge-drain layer 76 electrically, as well as two further configurations of the secondary window element 70. In FIG. 6, the electrically insulating layer 74 extends the furthest and constitutes the edge of the element 70. More precisely, it extends a distance $d_{61}$ from the outer boundary of the heating circuitry 72 and a distance $d_{62}$ from the charge-drain layer 76. It will be beneficial to the electrical insulation of the conductive layers 72, 76 if the distances $d_{61}$, $d_{62}$ do not go below a least positive value anywhere around the boundary of the window element 70, whereby the conductive layers 72, 76 are spaced apart.

It is the charge-drain layer 76 that extends up to the edge of the window element 70 shown in FIG. 7. At this edge, the electrically insulating layer 74 is shorter than the charge-drain layer 76 by a transversal distance $d_{72}$, and the (transversal) coverage area of the heating circuitry 72 reaches shorter than the electrically insulating layer 74 by a distance $d_{71}$. As already noted, the electrical insulation will to some extent depend on the least values of these distances.

As to the electrical connections, the charge-drain layer 76 shown in FIG. 6 is connected via an electrically conductive filament to a point on the screen. By allowing the filament to slack, thermal expansion of the secondary window element 70 can be accommodated. To avoid heat losses, ideally, the cross-sectional area of the filament is to be determined as the least value that is able to transport a current corresponding to the charge bombardment per unit time. Further considerations, such as mechanical strength, elasticity and resistance to mechanical or thermal wear may be taken into account.

In FIG. 8, the charge-drain layer 76 is connected via a thermally insulating, electrically conductive spacer 66, which takes the place of the thermally and electrically conductive spacer 62 in previously described embodiments. The electrically conductive spacer 66 allows electric current to flow from the screen 60, which is itself earthed in this embodiment. The spacer 66 preferably has low thermal conductivity to prevent heat from escaping to the screen 60. The spacer 66 may be manufactured by coating a piece of ceramic material with a thin conductive layer, e.g., metalized porcelain. Alternatively, the spacer may consist of a doped ceramic material, such as doped silica, or of some metal(loid) carbide, nitride or oxide. In the embodiment shown in FIG. 8, the heating circuitry 72 is encapsulated except at the terminal to which the source 30 is connected. In order for an object to make electric contact with the heating circuitry 72, it will need to pierce or damage the encapsulating material. For this reason, the right spacer 64 need not be electrically insulating. As already noted, however, the two spacers 62, 64 are preferably thermally insulating, which limits the draining of heat off the secondary wind element 70 and hence facilitates the maintenance of an even temperature distribution.

Figure 9:
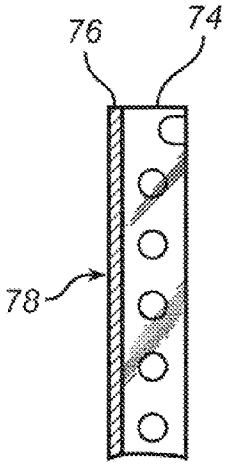
FIGS. 9 and 10 show two preferable details of geometries of a secondary window element.

FIG. 9 illustrates a secondary window element 70 in which the electrically insulating layer 74 and the charge-drain layer 76 are flush with one another at one of the edges, in accordance with an embodiment of the invention. The heating circuitry 72 is encapsulated in the electrically insulated layer 74 except for the top coil, which is in electric contact with the right-hand face of the electrically insulated layer 74.

Figure 10:
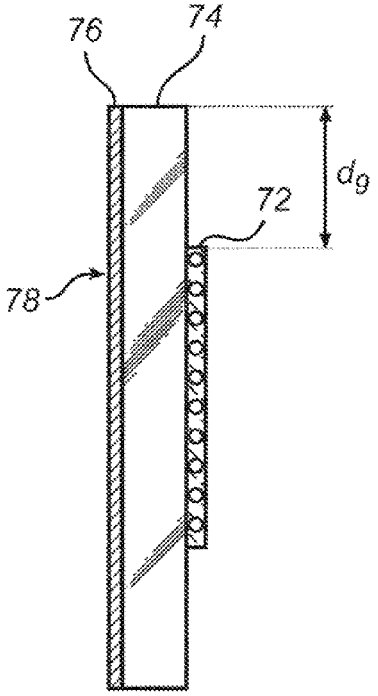

FIG. 10 illustrates, according to another embodiment, a window element 70 having a charge-drain layer 76 and insulating layer 74 of equal size and, additionally, heating circuitry 72 extending over a central portion of the downstream side of the element 70.

Figure 11:
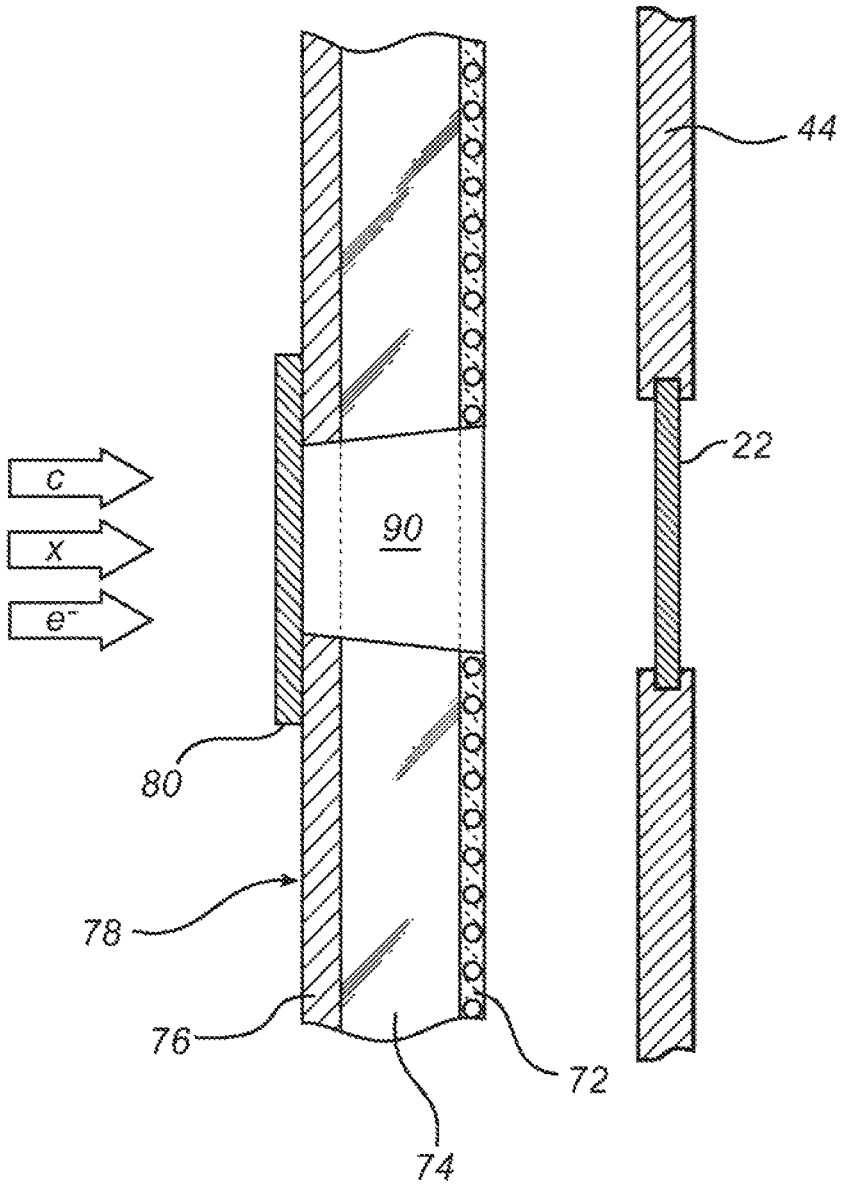
FIG. 11 is a detailed cross-sectional side view of a central portion of an X-ray window in accordance with the invention, wherein the cross section plane intersects a covered axial hole through the secondary window element.

FIG. 11 shows a secondary window element 70 having at least one part 72, 74, 76 that is not X-ray transparent. Instead, to allow X-rays to pass, the window element 70 comprises an axial hole (or aperture) 90 covered by an X-ray transparent plate 80, which can be heated conductively by means of the heating circuitry 72. The X-ray transparent plate 80 covers the hole 90 from the upstream side 78, which is advantageous in that debris impinges on—and can be cleaned from—a relatively simple geometry. In variations to this embodiment, the plate 80 may be arranged on the downstream side, which then makes the heat transfer from the heating circuitry 72 to the plate 80 more efficient.

FIG. 12 illustrates a process for securing the secondary window element 70 axially by clamping it between the spacers 62, 64. In the example shown in FIG. 12, the upper spacer 62 is downward biased by means of a spring. It is desirable to ensure mobility in at least one of the transversal directions (horizontally in FIG. 12), so that the secondary window element 70 is allowed to expand and contract in response to temperature changes. For this purpose, that portion of the secondary window element 70 which will be clamped between the spacers 62, 64 is coated with a graphite powder, preferably colloidal graphite or graphite flakes. With a suitably chosen graphite grain size, the resulting joint may have high electric conductivity and low friction to movement in the transversal directions. It is noted that the mechanical parts responsible for the clamping may be partitioned into at least two segments (e.g., there may be two or more pairs of spacers), which can be connected to different electric potentials in order to drive a current through the heating circuitry 72. This is suggested by FIG. 12, in which the heating circuitry 72 extends down to a terminal area on the lower face of the secondary window element.

Figure 12A:
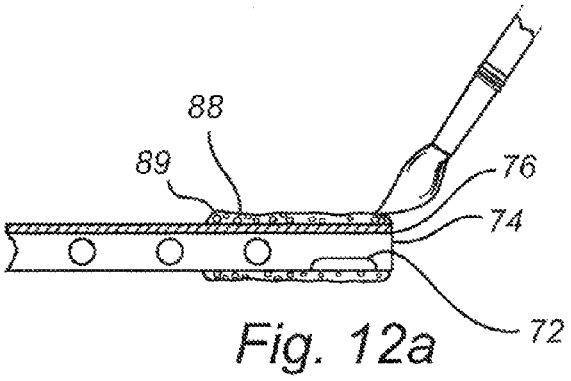
FIG. 12 illustrates a procedure for securing the secondary window element slidably by clamping it between thin layers of colloidal graphite.
Figure 12B:
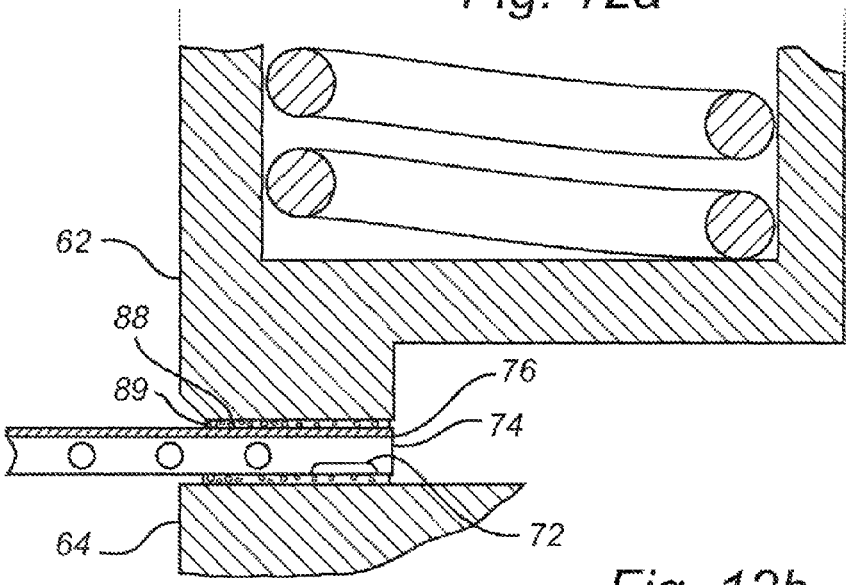
Figure 12C:
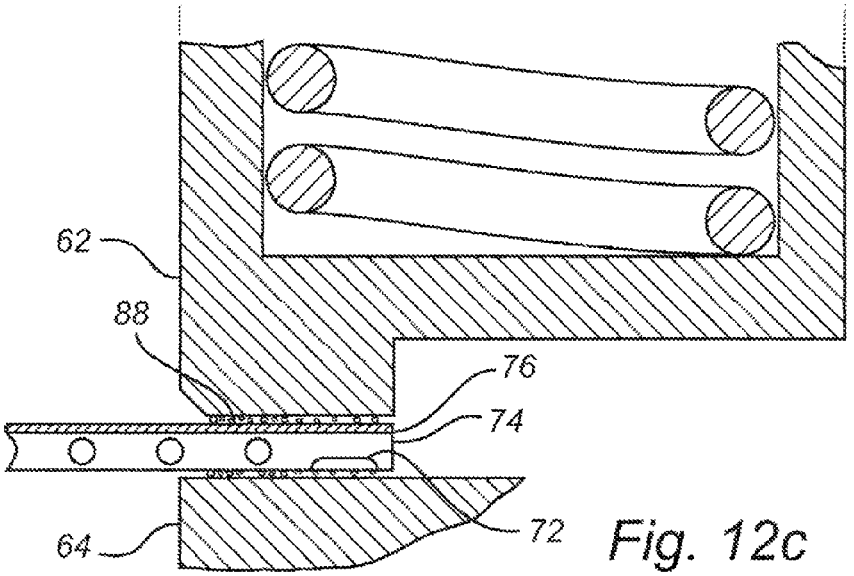

The coating process may comprise an initial application step, in which graphite powder 88 is applied to an edge portion of the secondary window element 70 (FIG. 12*a*). In a second step (FIG. 12*b*), the secondary window element 70 is inserted between the spacers 62, 64 and clamping pressure is applied. The X-ray window may be used immediately after the second step has been completed. If the graphite powder 88 is applied in a carrier liquid 89, the liquid 89 may evaporate after some time, depending on the temperature at which the X-ray window is stored and operated. The evaporation may change the electric and mechanical properties to some extent, but even after evaporation has completed (FIG. 12*c*), the coated faces of the secondary window element 70 will rest on a bed of graphite powder, which ensures low friction and adequate electric conductivity. This securing method differs from that shown in FIG. 6 in that the secondary window element 70 is in contact with solid powder particles instead of a film of molten metal.

The graphite powder 88 may be applied as a liquid, which may be a water suspension of graphite flakes or a paint containing an organic or nonorganic solvent. In one example, a graphite paint containing graphite flakes bonded by a cellulose resin with isopropanol as diluent was used. The average size of the graphite flakes was 1 μm and the graphite content was 20% by weight. A graphite paint with these characteristics may be purchased from Ted Pella, Inc. under the trade name Pelco®. Factors influencing the optimal graphite grain size may include the clamping pressure, the surface characteristics of the respective faces of secondary window element 70 and of the spacers 62, 64.

It is emphasised that FIG. 12 is simplified in order to increase clarity but is not necessarily to scale. In particular, the charge-drain layer 76 and the heating circuitry 72 in the electrically insulating layer 74 may be placed on different electric potentials by connecting each of the spacers 62, 64 to a separate electric source (not shown). In such a situation, it may be suitable to forestall charge leakage across the right-hand edge in one of the following manners. Firstly, the terminal area, in which a portion of the heating circuitry 72 makes electric contact with the downward face of the secondary window element, may be further separated from the edge, that is, it may be located further left on the drawing. Alternatively, the edges of the charge-drain layer 76 and the electrically insulating layer 74 may be separated from one another, e.g., according to one of the configurations shown in FIGS. 3, 7 and 8. For example, one may envision a secondary window element in which the charge-drain layer 76 ends a nonzero distance inside the clamped edge portion of the secondary window element, so that only the electrically insulating layer 74 will undergo powder coating and clamping. This example will result in a configuration similar to the one shown in FIG. 3, however, with the heating circuitry 72 integrated into the electrically insulating layer 74.

It is believed that the above method can be applied more generally for the purpose of creating an electrically conductive slidable or rotatable joint (e.g., a construction joint or plain bearing) between two or more objects. As such, a method for providing a slidable joint between a first and a second object may include:

- coating a first area on a first object with an electrically conductive powder, wherein the first area is substantially smooth;
- bringing the first area into contact with a second area on a second object, wherein the surface shape of the second area is adapted to that of the first area; and
- applying a clamping pressure in a direction substantially normal to the first and second areas.

Optionally, the method may include coating also the second area with conductive powder. This may lead to more reliable bonding and hence improved resistance to wear. The slidable joint may be subject to linear or rotary motion or a combination of these. If wet coating is used, then evaporation may optionally be allowed to complete before the clamping pressure is applied and/or movement is initiated.

The electrically conductive powder may be metallic or non-metallic. Preferably, the powder is chemically inert or corrosion-proof in the environment where it is to be used (including temperature, airborne contamination, atmospheric composition etc.). Example metals with these properties include molybdenum and vanadium. Suitable non-metallic powders include graphite powder, such as colloidal graphite, granular graphite, flaky graphite powder; as discussed above. The melting point of the conductive powder is preferably higher than the temperature of the intended environment, so that the powder remains in solid form during use.

FIG. 12 shows a double joint allowing three objects to move with respect to one another. A joint of this type is primarily suited for objects of relatively low weight or situations where a moderate clamping pressure is sufficient. The graphite grain size distribution may need to be adapted in accordance with the clamping pressure and the properties of the surfaces (e.g., coarseness) of the objects to be joined. The centre of an optimal grain size distribution will typically move towards larger sizes for higher clamping pressures. Since the use of relatively larger grain sizes may lead to a smaller effective contact surface, it may be suitable to coat a somewhat larger area of the objects. The coating process may be wet, as illustrated in FIG. 12. Alternatively, the graphite powder may be applied in dry form. Optionally, the graphite powder may be applied by heated coating or coating by electricity to improve its adhesion to the object. Further optionally, one may use an electrically conducting primer to create a smoother surface on the object to be coated.

While the invention has been illustrated and described in detail in the drawings and foregoing description, such illustration and description are to be considered illustrative or exemplary and not restrictive; the invention is not limited to the disclosed embodiments. For instance, the secondary window element may be embodied as a four-part entity comprising a charge-drain layer facing the reduced pressure region, an insulating layer, heating circuitry and then a further insulating layer facing the intermediate region.

Other variations to the disclosed embodiments can be understood and effected by those skilled in the art in practicing the claimed invention, from a study of the drawings, the disclosure and the appended claims. Any reference signs in the claims should not be construed as limiting the scope.

Itemized List of Embodiments

1. An X-ray window as defined in claim 1.

2. The X-ray window of embodiment 1, further comprising a screen (60), at least partially surrounding said secondary window element (70) on the side (78) facing the reduced pressure region, said screen being electrically conducting and connected to a charge sink.

3. The X-ray window of embodiment 2, wherein the charge-drain layer (76) is completely surrounded by the screen and overlaps by a distance ($d_1$) with the screen.

4. The X-ray window of embodiment 2 or 3, wherein the screen and said secondary window element are thermally insulated from one another.

5. The X-ray window of embodiment 4, further comprising a thermally insulating spacer (66) arranged between the screen and the charge-drain layer of the secondary window element and being in electric contact with both.

6. The X-ray window of embodiment 5, wherein the thermally insulating spacer contains one of the following materials: metalized alumina, betaalumina, doped silica, a doped ceramic material, a metalized ceramic material.

7. The X-ray window of embodiment 4, further comprising:

a thermally and electrically insulating spacer (62) arranged between the screen and the secondary window element; and an electrically conductive filament (68) connecting the charge-drain layer with the screen.

8. The X-ray window of embodiment 7, wherein the thermally and electrically insulating spacer (62) contains a glass-ceramic material, preferably one containing $Al_2O_3$.

9. The X-ray window as defined in any of the preceding embodiments, wherein said electrically insulating layer contains one of the following materials: diamond, $SiO_2$, BeO, $Al_2O_3$, BN.

10. The X-ray window of any of the preceding embodiments, wherein the charge-drain layer contains one of the following materials: graphite, diamond, amorphous carbon, chromium, nickel, titanium, a refractory metal.

11. The X-ray window of any of the preceding embodiments, wherein the secondary window element is X-ray-transparent.

12. The X-ray window of any one of the preceding embodiments, wherein the layers of the secondary window element define at least one axial hole (90), which is covered by an X-ray-transparent element (80).

The invention claimed is:

1. An X-ray window for separating an ambient pressure region from a reduced pressure region, the window comprising:

a primary X-ray-transparent window element separating the ambient pressure region from an intermediate region;

a secondary window element separating the intermediate region from the reduced pressure region, which secondary window element comprises a side facing the reduced pressure region for receiving a contaminant depositing thereon; and heating means for applying an electric voltage between terminals of said secondary window element for thereby evaporating contaminant having deposited thereon, wherein said secondary window element comprises:

a charge-drain layer, which faces the reduced pressure region and is connected to a charge sink; and heating circuitry, which is electrically insulated from the charge-drain layer, wherein said terminals, between which the voltage is applied, are located at a plurality of distinct points on the heating circuitry.

2. The X-ray window of claim 1, wherein the heating circuitry comprises an insulated wire.

3. The X-ray window of claim 2, wherein the heating circuitry is arranged in abutment with the charge-drain layer.

4. The X-ray window of claim 1, further comprising an electrically insulating layer arranged to electrically insulate the charge-drain layer from the heating circuitry.

5. The X-ray window of claim 1, wherein the secondary window element further comprises a first region and a second region, wherein the first region has a higher transparency to X-ray radiation than the second region.

6. The X-ray window of claim 4, wherein the electrically insulating layer comprises an indentation located in said first region.

7. The X-ray window of claim 4, wherein the electrically insulating layer defines an aperture located in said first region.

8. The X-ray window any of claim 1, wherein the heating circuitry is arranged in an undulating pattern.

9. The X-ray window of claim 4, wherein the undulating pattern has a lower density in said first region than in said second region.

10. The X-ray window of claim 1, wherein the charge-drain layer defines an indentation located in said first region.

11. The X-ray window of claim 1, wherein the heating circuitry is a bifurcated circuit.

12. The X-ray window of claim 1, wherein the window is secured by being inserted into a slit after coating with colloidal graphite.

13. The X-ray window of any of claim 1, wherein the heating circuitry contains one of the following materials:

graphite, pyrolytic carbon, high-resistance metal, high-resistance alloy.

14. The X-ray window of claim 4, wherein:

the heating wire is encapsulated in the electrically insulating layer.

15. The X-ray window of claim 4, wherein:

the heating circuitry extends at most over the electrically insulating layer; and the charge-drain layer extends at least a distance outside the heating circuitry, at least over a portion of a boundary.

16. The X-ray window of claim 14, wherein a portion of a boundary of the window is inserted into a slit in a reservoir containing electrically conducting fluid.

17. The X-ray window of claim 1, wherein the electrically insulating layer extends at least a first distance outside the heating wire and at least a second distance outside the charge-drain layer, at least over a portion of a boundary.

18. An X-ray-source housing comprising:

a gas-tight housing; and the X-ray window of claim 1, provided in an outer wall of said housing.

19. An X-ray source comprising:

the X-ray-source housing of claim 18;

an electron source provided inside the housing; and a liquid-jet electron target provided inside the housing.

* * * * *